US006361445B1

(12) United States Patent
Zeilinger

(10) Patent No.: US 6,361,445 B1
(45) Date of Patent: Mar. 26, 2002

(54) WATER SLIDE

(75) Inventor: Brian K. Zeilinger, Janesville, WI (US)

(73) Assignee: Playstar, Inc., Janesville, WI (US)

( * ) Notice: Subject to any disclaimer, the term of this patent is extended or adjusted under 35 U.S.C. 154(b) by 0 days.

(21) Appl. No.: 09/533,027

(22) Filed: Mar. 22, 2000

Related U.S. Application Data

(60) Provisional application No. 60/172,251, filed on Apr. 9, 1999, now abandoned.

(51) Int. Cl.[7] ..... A63G 21/18
(52) U.S. Cl. ..... 472/117; 472/116; 472/128
(58) Field of Search ..... 472/116, 117, 472/128; 104/69, 70, 53

(56) References Cited

U.S. PATENT DOCUMENTS

| | | | | |
|---|---|---|---|---|
| 790,613 A | * | 5/1905 | Boyle | 472/116 |
| 2,095,494 A | | 3/1937 | Dobbs | |
| 2,446,905 A | | 8/1948 | Buffum | |
| 3,715,120 A | * | 2/1973 | Peltola | 472/116 |
| 4,270,748 A | | 6/1981 | Ray | |
| 4,343,464 A | | 8/1982 | Dose | |
| 4,805,898 A | | 2/1989 | Jacober et al. | |
| 4,943,048 A | | 7/1990 | Hentges | |
| 5,407,393 A | | 4/1995 | Schmidt | |
| 5,427,574 A | | 6/1995 | Donnelly-Weide | |
| 5,779,553 A | * | 7/1998 | Langford | 472/117 |

OTHER PUBLICATIONS

The Step2 Company, "Step 2" (1997).

* cited by examiner

*Primary Examiner*—Kien T. Nguyen
(74) *Attorney, Agent, or Firm*—Michael Best & Friedrich LLP

(57) ABSTRACT

The present invention provides a water slide that includes a sliding surface and an entry end. The entry end of the water slide is configured to be positioned adjacent to the lower end of a downhill slide so that the sliding surface of the water slide and the sliding surface of the downhill slide form a continuous sliding surface. The water slide is adapted to hold a supply of water over substantially the entire sliding surface. Positioning a water supply over the entire sliding surface facilitates the water-sliding action as a child slides through the water slide. In another form of the invention, the water slide includes a drain that extends through the sliding surface of the slide. The drain permits easy replacement of unclean water with fresh water.

20 Claims, 5 Drawing Sheets

19
20
31
42
26
24
25
40
38
62
60
61
41
13
50A
52
55
50B
52
55
39
50C
65
52
43
37

WATER SLIDE

CROSS-REFERENCE TO RELATED APPLICATIONS

This application claims priority to provisional application Ser. No. 60/172,251 which was filed Apr. 9, 1999, now abandoned.

BACKGROUND OF INVENTION

This invention relates to a children's water slide, and more particularly, to a children's water slide that is adapted to be placed against the lower end of a downhill children's slide.

Downhill children's slides are commonly known in the art. The slides are typically used as either freestanding devices or they may be attached to a playstation. Children use downhill slides by climbing the playstation (or a ladder in the case of a freestanding device) and descending to the ground via the slide.

The prior art includes devices that seek to combine the amusement of sliding down a conventional children's slide and playing in water. One such device is disclosed in U.S. Pat. No. 4,343,464. This patent discloses a playground container that can be used as a sandbox or wading pool. The container includes a number of cover panels that are hingedly connected to the sandbox/pool. When the cover panels are properly arranged, the hinged cover panels form a slide and a ladder. In use, children slide down the slide and drop into the sand box/pool.

Another device that combines children's slides and water is disclosed in U.S. Pat. No. 4,805,898. This patent discloses a recreational water slide system that includes a landing or splash pad at the bottom end of a downhill slide. The splash pad is buoyant and floats on the surface of the water. In use, children slide down the slide and off of the splash pad into the pool.

However, neither of these systems is particularly useful without the associated sandbox or pool. Moreover, there is little or no sliding action that takes place once the child leaves the end of the slide.

U.S. Pat. No. 4,943,048 relates a staircase amusement slide. The disclosed slide is mounted on a staircase and includes a terminal section that is adapted to be placed on the ground adjacent to the rest of the slide. The terminal section of the slide does not function adequately as a water slide because of the limited sliding area at the terminal section and the inability of the terminal section to hold an adequate supply of water.

SUMMARY OF THE INVENTION

The present invention solves the aforementioned problems by providing a water slide that includes a sliding surface and an entry end. The entry end of the water slide is configured to mate with the lower end of a downhill slide so that the sliding surface of the water slide and the sliding surface of the downhill slide form a continuous sliding surface. The water slide is adapted to hold a supply of water that facilitates the water-sliding action of a child as the child slides from the downhill slide and enters the water slide. The water slide also preferably includes a drain that extends through the sliding surface of the slide in order to permit easy replacement of unclean water with fresh water.

The present invention also provides a water slide that includes a left side, a right side, a sliding surface and an entry end. The left and right side of the water slide are configured to mate with the lower end of a corresponding left and right side on a downhill slide such that the right side of the water slide and the right side of the downhill slide form a continuous right side, and the left side of the water slide and the left side of the downhill slide form a continuous left side. The left side and/or the right side of the water slide include one or more flanges extending outward from the left and/or right side. The flanges include openings (e.g., slots) that are adapted to receive a fastener (e.g., a stake) in order to secure the water slide to the ground or some other surface. The left side and the right side of the water slide may also be recessed such that the water slide is able to mate with a downhill slide that has left and right sides extending past the lower end of the downhill slide.

In another embodiment of the invention, the water slide include left and right sides, entry and finish ends and a sliding surface which all form a reservoir that is adapted to contain a supply of water over substantially the entire sliding surface. Positioning the supply of water over the entire sliding surface provides superior water-sliding action as a child slides through the water slide.

A principal advantage of the invention is to provide a water slide that is easily adapted to mate with a conventional children's downhill play slide.

Another advantage of the invention is to provide a water slide that laterally supports a child as the child slides through the water slide.

An additional advantage of the invention is to provide a water slide that mates with a conventional children's downhill slide such that a continuous sliding surface is maintained as a child slides from the downhill slide and enters the water slide.

Another advantage of the invention is to provide a water slide that has a supply of water over substantially the entire sliding surface of the water slide.

An additional advantage of the invention is to provide a water slide that mates with a conventional children's downhill slide and has improved water-sliding action.

Still another advantage of the invention is to provide a water slide that includes a drain such that unclean water can be easily replaced with fresh water.

Another advantage of the invention is to provide a water slide that includes a drain such that water can be removed from the slide when the slide is not in use.

Yet another advantage of the invention is to provide a water slide that has sides that mate with similar sides of an adjoining children's downhill slide.

Other features and advantages of the invention are set forth in the following drawings and claims.

DETAILED DESCRIPTION OF THE PREFERRED EMBODIMENT

Figure 1:
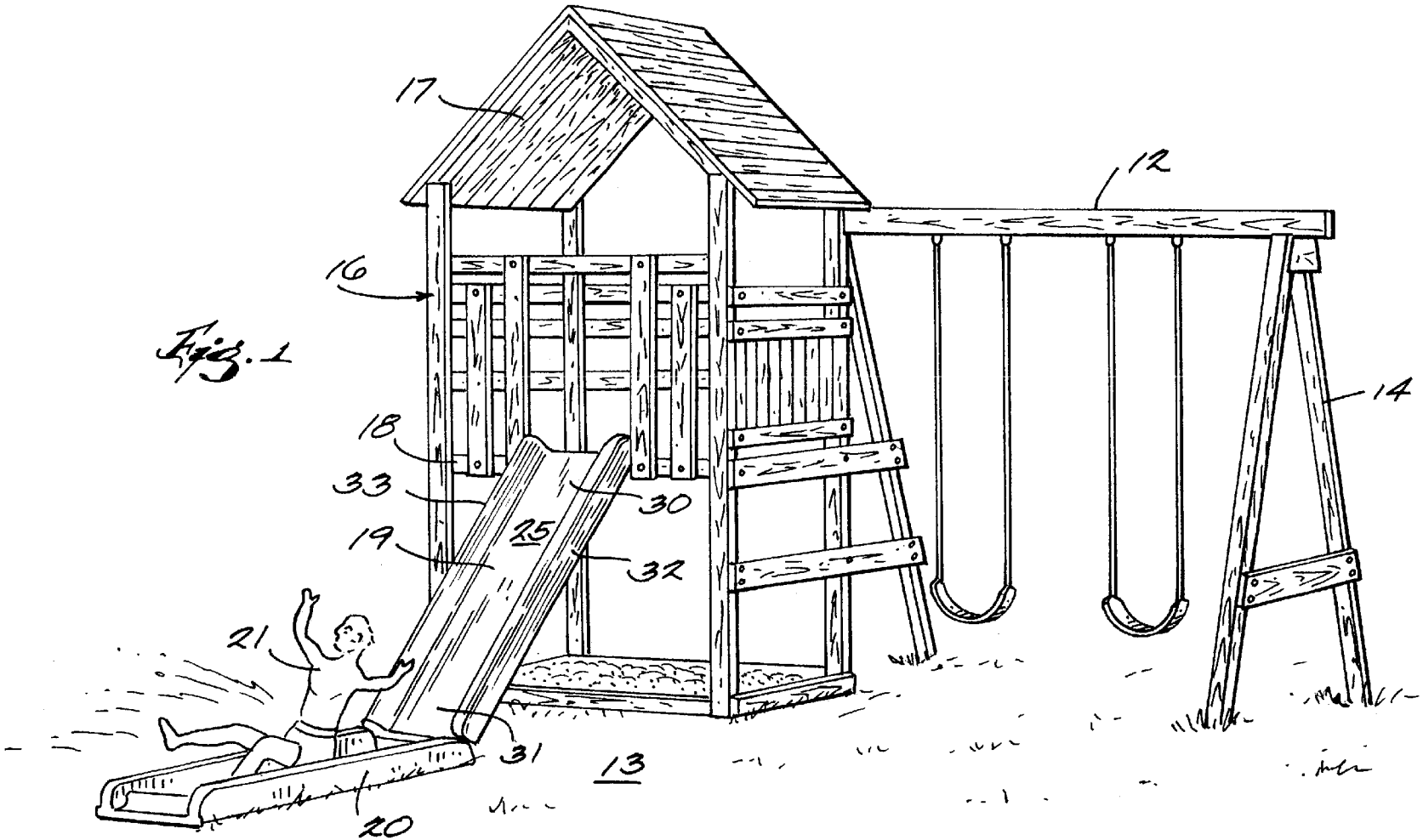
FIG. 1 is a perspective view of a playstation that has a conventional children's downhill slide mounted to a playstation and a water slide of the present invention located adjacent to the downhill slide.

A typical playstation 10 that incorporates a water slide 20 of the present invention is shown in FIG.1. The playstation 10 includes a cross beam 12 that is supported on one side by an A-frame 14 and on the opposite side by a tower 16. The tower 16 includes a roof 17 and a landing area 18 that allows individuals (e.g., children) to stand in the tower 16. A conventional downhill slide 19 extends from the landing area 18 to the ground 13 where the downhill slide 19 communicates with the water slide 20 where a child 21 is shown sliding through the water slide 20.

The downhill slide 19 typically includes an upper end 30, a lower end 31 and a sliding surface 25 extending between the upper end 30 and a lower end 31. The downhill slide further includes a left side 32 and a right side 33 that serve to provide hand rails as the child 21 slides down the sliding surface 25 of the downhill slide 19.

Figure 2:
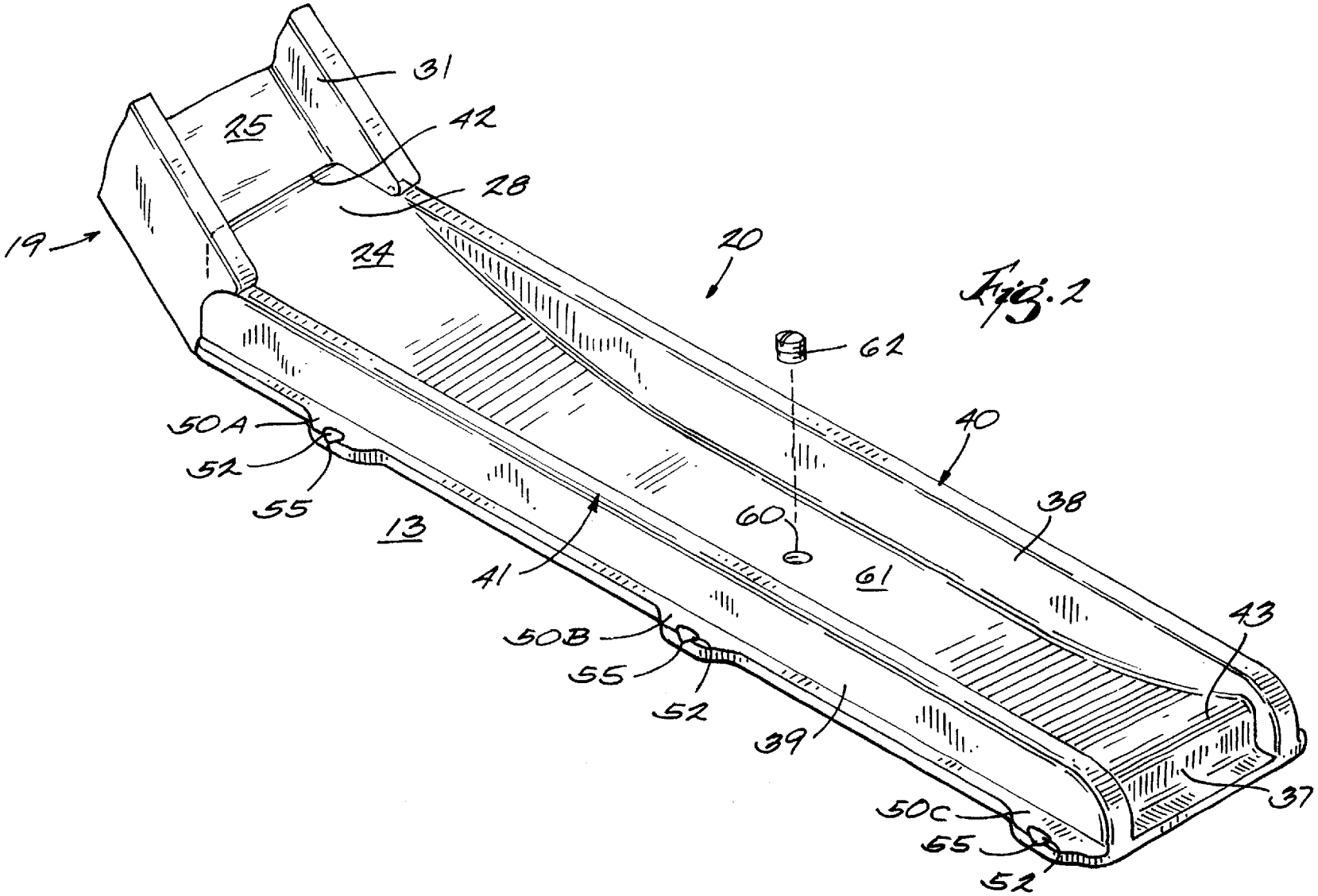
FIG. 2 is an enlarged perspective view of the water slide of the present invention attached to the lower end of a children's downhill slide.
Figure 3:
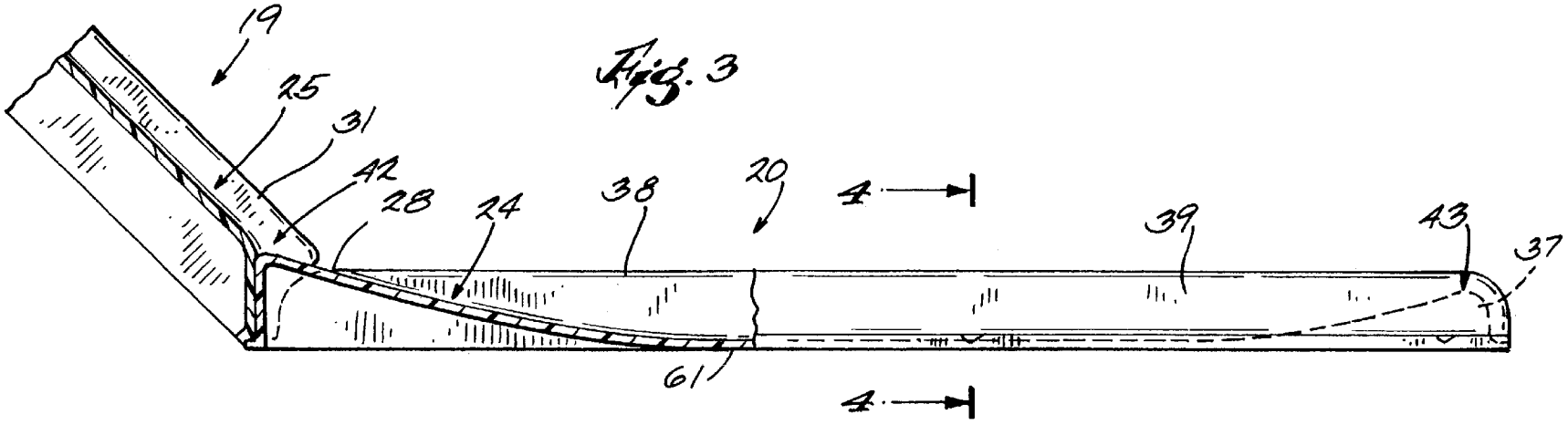
FIG. 3 is a partial side section view of the water slide of FIG. 2 and a portion of an attached downhill slide.
Figure 4:
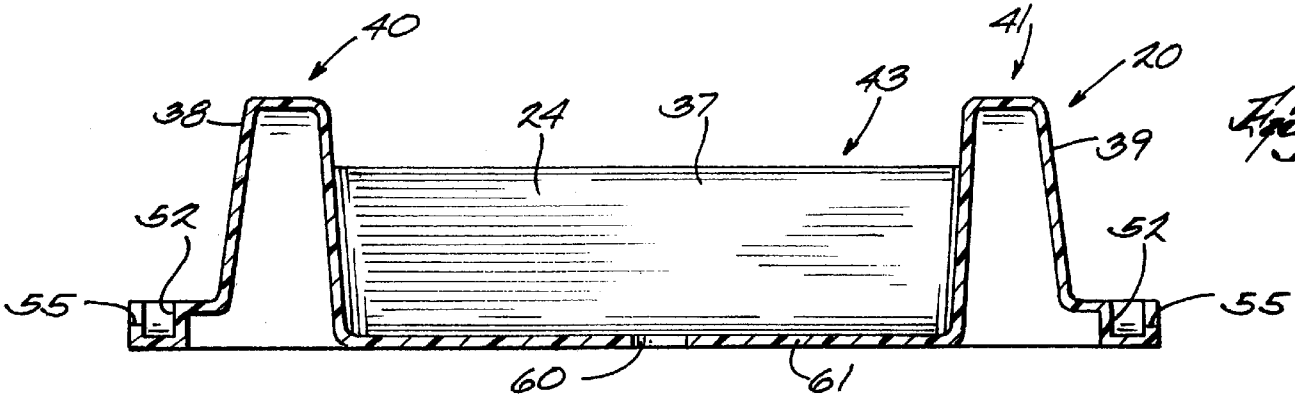
FIG. 4 is a section view of the water slide of FIG. 3 taken along line 4—4.
Figure 5:
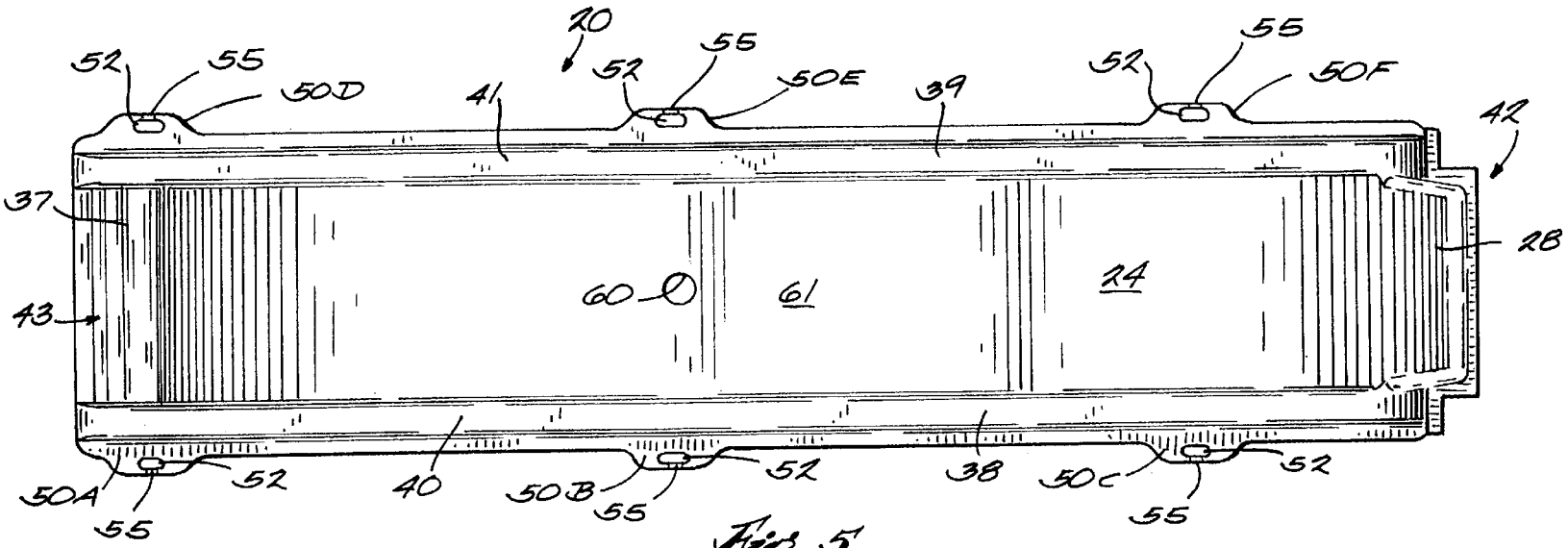
FIG. 5 is a top view of the water slide of FIG. 2.

As shown most clearly in FIGS. 2 and 3, the water slide 20 is adapted to be placed on the ground 13 adjacent to the lower end 31 of the downhill slide 19. The water slide 20 includes a sliding surface 24 and an entry end 28 that is positioned adjacent to the lower end 31 of the downhill slide 19 such that the sliding surfaces 24, 25 of the downhill slide 19 and the water slide 20 form a continuous sliding surface. The slope of the sliding surface 24 at the entry end 28 of the water slide 20 preferably matches the slope of the sliding surface 25 at the lower end 31 of the downhill slide 19. Matching the slopes of the sliding surfaces 24, 25 where the sliding surfaces 24, 25 meet assures that an optimum sliding surface is maintained. The entry end 28 of the water slide 20 preferably includes an end wall 49 that is secured by a conventional method to an end wall 69 at the lower end 31 of the downhill slide 19.

FIGS. 4–9 further illustrate the water slide 20 of the present invention. The water slide 20 includes the aforementioned sliding surface 24 and entry end 28 and further includes a finish end 37, a left side 38 and a right side 39. The left side 38 of the water slide 20 is configured to be positioned adjacent to the left side 32 of the downhill slide 19 such that the adjacent left sides 32, 38 form a continuous left side. In addition, the right side 39 of the water slide 20 is configured to be positioned adjacent to the right side 33 of the downhill slide 19 such that the adjacent right sides 33, 39 form a continuous right side.

The left and right sides 32, 33 of most conventional downhill slides 19 extend past the sliding surface 25 of the downhill slide 19. The left and right sides 32, 33 are positioned in this manner in order to provide handholds for a child as the child exits the lower end 31 of the downhill slide 19. Therefore, in a preferred form of the invention, the left and right sides 38, 39 of the water slide 20 are preferably recessed from the entry end 28 so that the entry end 28 can be placed between the projecting left and right sides 32, 33 of the downhill slide 19 (shown most clearly in FIG. 2).

In another form of the invention, flanges 50A, 50B, 50C extend perpendicularly outward from the right side 39 of the water slide 20 and flanges 50D, 50E, 50F extend perpendicularly outward from the left side 38 of the water slide 20. Each flange 50A-F preferably includes slots 52 that are adapted to receive fasteners (e.g., stakes) for securing the water slide 20 to the ground 13. The slots 52 preferably extend substantially parallel to the left and right sides 38, 39 of the water slide 20. Each flange 50A-F may also include a recess 55 which extends from the slot 52 to an outer surface 56 of each flange 50A-F. The recess 55 is adapted to receive some portion of a stake (e.g., a hook) such that the stake extends over the flange when the stake is pounded into the ground 13.

In an alternative form, the left and right sides 38, 39 include embosses (not shown) that are molded into the water slide 20. The embosses are adapted to receive fasteners that are used to secure the left and right sides 38, 39.

Figure 6:
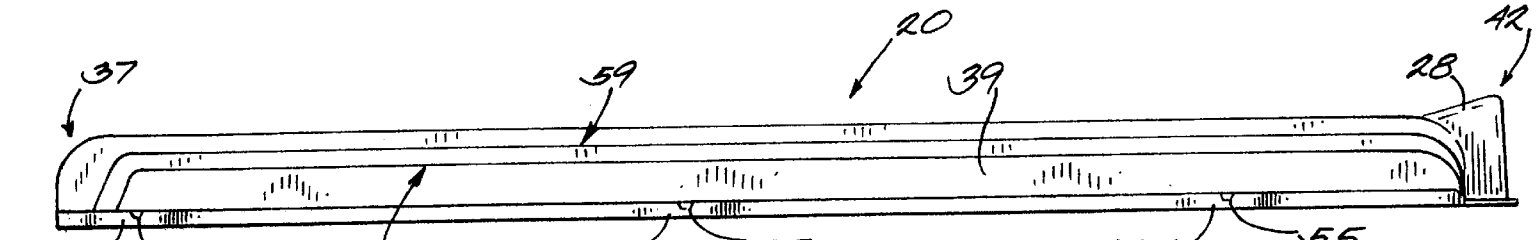
FIG. 6 is a front view of the water slide of FIG. 2.
Figure 7:
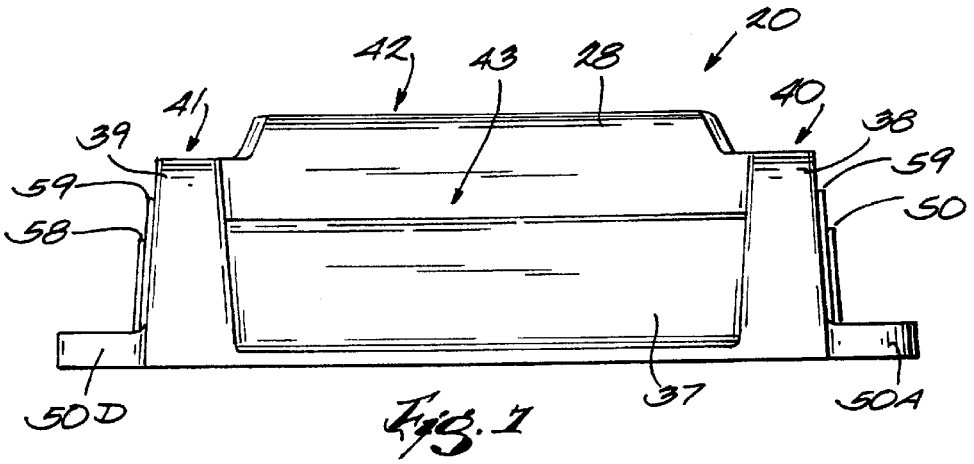
FIG. 7 is a side view of the water slide of FIG. 2 taken from the finish end.
Figure 8:
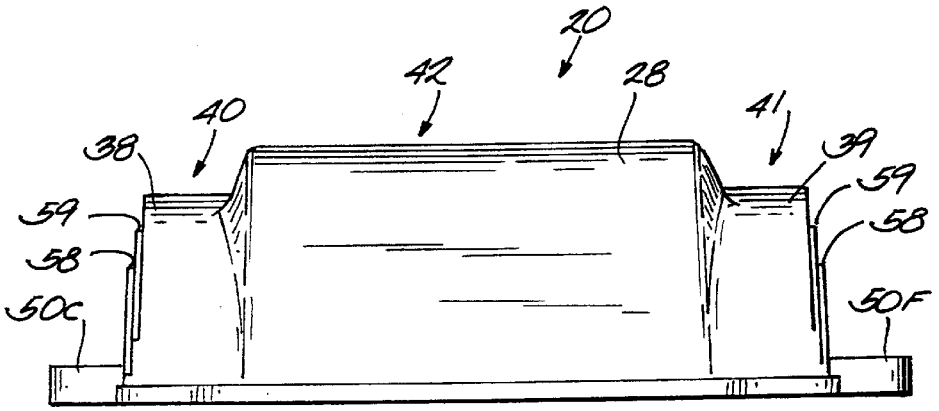
FIG. 8 is a side view of the water slide of FIG. 2 taken from the entry end.
Figure 9:
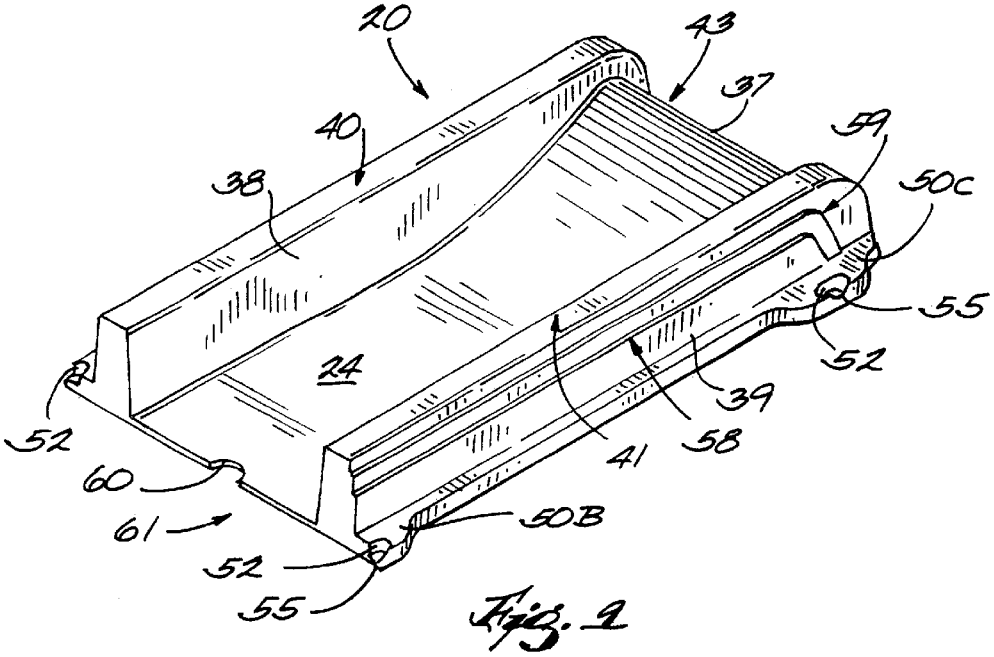
FIG. 9 is a perspective view of a portion of the water slide of FIG. 2 that includes the finish end.

The left and right sides 38, 39 of the water slide 20 preferably include projections 58, 59 (shown most clearly in FIGS. 6 and 9). The projections 58, 59 provide structural support along the length of the water slide 20. The water slide 20 is preferably made from high density polyethylene, and the projections 58, 59 are preferably positioned along the entire length of the left and right sides 38, 39.

In another form of the invention, the water slide 20 includes a drain 60. The drain 60 is used to remove any standing (i.e., unclean) water from the water slide 20 so that the unclean water may be replaced with fresh water. The drain 60 is preferably positioned at the lowest portion 61 of the sliding surface 24 so that the drain 60 is able to remove all of the unclean water from the water slide 20. The drain may have any configuration commonly known in the art such as a plug 62 (see FIG. 2) that has external threads which screw into an internally-threaded drain hole 60.

The foregoing description of the present invention has been presented for purposes of illustration and description. The description is not intended to limit the invention to the form is disclosed herein. Consequently variations and modifications commensurate with the above-teachings and the skill or knowledge of the prior art, are within the scope of the present invention. The embodiments described herein are intended to explain the best modes for practicing the invention and to enable others skilled in the art to utilize the invention and the disclosed or other embodiments, and with various modifications required by the particular applications or uses of the present invention. It is intended that the appended claims be construed to include alternative embodiments to the extent permitted by the prior art.

What is claimed is:

1. A water slide adapted to be positioned adjacent to a downhill slide having an upper end, a lower end, a left side, a right side and a sliding surface extending between the lower end and the upper end and the left side and the right side, the water slide comprising:

a sliding surface;

an entry end configured to be positioned adjacent to the lower end of the downhill slide such the sliding surface of the water slide and the sliding surface of the downhill slide form a continuous sliding surface;

a right side configured to mate with the right side of the downhill slide so that the right side of the water slide and the right side of the downhill slide form a continuous right side;

a left side configured to mate with the left side of the downhill slide so that the left side of the water slide and the left side of the downhill slide form a continuous left side;

a first flange extending outward from one of the left side and the right side, the first flange being adapted to secure the water slide; and a second flange extending outward from the other of the left side and the right side to the first flange, the second flange being adapted to secure the water slide;

wherein the first flange and the second flange extend perpendicularly outward from the left side and the right side; and wherein the first flange and the second flange include slots that are adapted to receive fasteners for securing the water slide.

2. The water slide of claim 1 wherein the slots extend substantially parallel to the left side and the right side.

3. The water slide of claim 1 further comprising a drain extending through the sliding surface for removing water from the water slide.

4. The water slide of claim 3 wherein the sliding surface includes a lowest portion and the drain extends through the lowest portion of the sliding surface.

5. The water slide of claim 1 wherein the left side and the right side of the water slide are recessed from the entry end so that the entry end of the water slide mates with the lower end of the downhill slide when the right side and the left side of the downhill slide extend outward past the lower end of the downhill slide.

6. The water slide of claim 1 wherein the left and right sides and the entry end of the water slide each include a substantially horizontal upper edge.

7. The water slide of claim 6 wherein the upper edges of the left and right sides are lower than the upper edge of the entry end.

8. A water slide adapted to be positioned adjacent to a downhill slide having an upper end, a lower end, a left side, a right side and a sliding surface extending between the lower end and the upper end and the left side and the right side, the water slide comprising:

a sliding surface;

an entry end configured to be positioned adjacent to the lower end of the downhill slide such the sliding surface of the water slide and the sliding surface of the downhill slide form a continuous sliding surface;

a right side configured to mate with the right side of the downhill slide so that the right side of the water slide and the right side of the downhill slide form a continuous right side;

a left side configured to mate with the left side of the downhill slide so that the left side of the water slide and the left side of the downhill slide form a continuous left side; and a first flange extending outward from one of the left side and the right side, the first flange being adapted to secure the water slide;

wherein the left side and the right side of the water slide are recessed from the entry end so that the entry end of the water slide mates with the lower end of the downhill slide when the right side and the left side of the downhill slide extend outward past the lower end of the downhill slide.

9. The water slide of claim 8 further comprising a drain extending through the sliding surface for removing water from the water slide.

10. The water slide of claim 8 further comprising a second flange extending outward from the other of the left side and the right side to the first flange, the second flange being adapted to secure the water slide.

11. The water slide of claim 10 wherein the first flange and the second flange extend perpendicularly outward from the left side and the right side.

12. The water slide of claim 11 wherein the first flange and the second flange include slots that are adapted to receive fasteners for securing the water slide.

13. The water slide of claim 12 wherein the slots extend substantially parallel to the left side and the right side.

14. A water slide adapted to be positioned adjacent to a downhill slide having an upper end, a lower end, a left side, a right side and a sliding surface extending between the lower end and the upper end and the left side and the right side, the water slide comprising:

a sliding surface;

an entry end configured to mate with the lower end of the downhill slide so that the sliding surface of the water slide and the sliding surface of the downhill slide form a continuous sliding surface;

a finish end;

a right side configured to mate with the right side of the downhill slide so that the right side of the water slide and the right side of the downhill slide form a continuous right side;

a left side configured to mate with the left side of the downhill slide so that the left side of the water slide and the left side of the downhill slide form a continuous left side; and wherein the left and right sides, the entry and finish ends and the sliding surface form a reservoir being adapted to contain a supply of water over substantially the entire sliding surface;

wherein the left and right sides and the entry and finish ends of the water slide each include a substantially horizontal upper edge; and wherein at least one of the upper edges includes an emboss that is adapted to receive a fastener for securing the water slide to the ground.

15. The water slide of claim 14 wherein the upper edges of the left and right sides are lower than the upper edge of the entry end.

16. A water slide adapted to be positioned adjacent to a downhill slide having an upper end, a lower end, a left side, a right side and a sliding surface extending between the lower end and the upper end, and the left side and the right side, the water slide comprising:

a sliding surface;

an entry end configured to mate the lower end of the downhill slide so that the sliding surface of the water slide and the sliding surface of the downhill slide form a continuous sliding surface;

a finish end;

a right side configured to mate with the right side of the downhill slide so that the right side of the water slide and the right side of the downhill slide form a continuous right side;

a left side configured to mate with the left side of the downhill slide so that the left side of the water slide and the left side of the downhill slide form a continuous left side; and a supply of water positioned between the left and right sides and the entry and finish ends over substantially the entire sliding surface of the water slide;

wherein the left side and the right side of the water slide are recessed from the entry end so that the entry end of the water slide mates with the lower end of the downhill slide when the right side and the left side of the downhill slide extend outward past the lower end of the downhill slide.

17. The water slide of claim 16 further comprising a drain extending through the sliding surface for removing water from the water slide.

18. The water slide of claim 17 wherein the sliding surface includes a lowest portion and the drain extends through the lowest portion of the sliding surface.

19. The water slide of claim 16 wherein the left and right sides and the finish and entry ends of the water slide each include a substantially horizontal upper edge.

20. The water slide of claim 19 wherein the upper edges of the left and right sides are lower than the upper edge of the entry end.

* * * * *